US005881385A

United States Patent [19]

Hochmuth

[11] Patent Number: 5,881,385

[45] Date of Patent: Mar. 16, 1999

[54] GOALKEEPER'S GLOVE

[76] Inventor: Peter Hochmuth, Weissenburger Str. 19, D-91757 Treuchtlingen, Germany

[21] Appl. No.: 60,441

[22] Filed: Apr. 15, 1998

[30] Foreign Application Priority Data

Apr. 14, 1997 [DE] Germany ..... 297 06 661 U

[51] Int. Cl.[6] ..... A41D 19/00

[52] U.S. Cl. ..... 2/161.1; 2/163

[58] Field of Search ..... 2/161.1, 163, 16, 2/159, 21, 20, 18, 161.6

[56] References Cited

U.S. PATENT DOCUMENTS

| | | | |
|---|---|---|---|
| 1,066,480 | 7/1913 | Finlay | 2/163 |
| 3,386,104 | 6/1968 | Casey | 2/161.6 |
| 4,681,012 | 7/1987 | Stelma et al. | 2/163 |
| 4,995,119 | 2/1991 | Codkind | 2/163 |
| 5,093,933 | 3/1992 | Berry | 2/161.6 |
| 5,661,853 | 9/1997 | Wilmot | 2/163 |
| 5,809,571 | 9/1998 | Spitzer | 2/161.1 |

*Primary Examiner*—Amy B. Vanatta
*Attorney, Agent, or Firm*—Anderson, Kill & Olick, P.C.

[57] ABSTRACT

A goalkeeper's glove including upper and inner portions having, respectively, four upper and inner finger regions and upper and inner hand regions, with each upper finger region being connected with a respective inner finger region along their lateral edges and forming together a common free end having a finger cap, and with at least one fingertip cap being provided with a hat-shaped elastically compressible padding formed of a porous rubber material and fixedly secured at one of its side to one of upper and inner finger regions forming the at least one fingertip cap, the padding being formed as a finger seat open at its side opposite to the one side.

9 Claims, 1 Drawing Sheet

GOALKEEPER'S GLOVE

BACKGROUND OF THE INVENTION

1. Field of the Invention

The present invention relates to a goalkeeper's glove including un upper portion having four upper finger regions and an upper hand region, and an inner portion having four inner finger regions and an inner hand region, with each upper finger region being connected with a respective inner finger region along lateral edges thereof, and with each upper finger region forming, together with the respective inner finger region, at their common free end, a fingertip cap with at least one fingertip cap being provided with an elastic compressible padding which is secured in a respective finger and is formed of a porous rubber-like material and has a hatlike shape.

2. Description of the Prior Art

A goalkeeper's glove of the above-described type is disclosed in German utility model DE-GM 29 00 843. In the goalkeeper's glove disclosed in this German utility Model, the hat-shaped padding is manufactured independently of the glove and is pushed into the respective glove finger after the glove has been stitched and completely finished. At that, the outer surface of the hat-shaped padding is covered with glue so that upon its insertion it becomes glued to both upper and inner regions of the respective finger. Such a manufacturing process is rather expensive. The hat-shaped padding forms in the finger a completely closed socket so that the fingertip cap is also padded at the side of the finger nail. It is technically very difficult to form a hat-shaped part, which formed as a completely circumferentially closed socket or cup, by, e.g., injection-molding.

Accordingly, an object of the present invention is to provide a goalkeeper's glove of the above-described type the manufacturing costs of which associated with manufacturing of the hat-shaped padding are substantially reduced.

SUMMARY OF THE INVENTION

This and other objects of the present invention, which will become apparent hereinafter, are achieved by providing a hat-shaped padding which is formed as a finger seat open at its side which is opposite to the finger seat side secured to a corresponding upper or inner finger region of the respective finger.

With a goalkeeper's glove according to the present invention, the hat-shaped padding is secured to the respective upper or inner finger region of the respective finger, e.g., glued thereto or injection molded thereon, before the two finger regions, upper and inner, are stitched together. Thus, a respective upper or inner finger region of the respective pair of the finger regions is stitched to another finger region of the pair, to which the hat-shaped padding is secured, only after the hat-shaped padding has been secured to the another finger region. This results in completely different manufacturing process of forming the goalkeeper's glove and the hat-shaped padding. A hat-shaped padding, which is formed as a finger seat open at one side, is easy to manufacturer, and it meets all of the essential demands required from a fingertip cap padding.

The inner surface of the upper or inner finger region, to which the padding is secured, e.g., injection molded thereon, is generally formed of any material which generally meets the requirements of the goalkeeper's glove material. It is particularly preferable and advantageous to form the inner surface of the corresponding upper or inner region as a pierced textile layer to which the hat-shaped padding is secured. Such a textile layer insures an improved engagement with and retaining of an injection molded padding.

The padding is formed, as it has already been discussed above, of a rubber-like material, e.g., sponge rubber or a suitable plastic foamed material. It is particularly preferable and advantageous to use a polyurethane foamed material for the padding. The polyurethane foamed material is very light and can be easily injection-molded.

It is further particularly preferable and advantageous when the end wall has a thickness greater than the side wall. The fingertips are particularly sensitive at their free ends, and an increased thickness of a portion of the padding, which is associated with the fingertip, can be easily obtained. The outer contour of the hat-shaped padding can be, e.g., strictly rectangular. However, it is particularly preferable and advantageous when the height of the hat-shaped padding gradually decreases toward the lateral edge of the upper/inner finger region pair. This inclination facilitate stitching of the upper glove portion to the inner glove portion.

It is particularly advantageous and preferably when a finger region, to which the hat-shaped padding is not secured, loosely engages the padding. An adequate padding is still provided even when the other finger region is not fixedly secured to the padding, e.g., the padding is not glued thereto. For the desired function of the padding, it is sufficient which the padding is fixedly secured only to one of a pair upper/inner finger regions.

It is possible to directly assemble both upper and inner finger regions and to stitch them together after the padding is injection-molded to one of the two finger regions. However, it is particularly preferable and advantageous when the injection-molded hat-shaped padding forms a seam ledge along the lateral edges of the upper/inner finger region pair. This seam ledge increases the abutment surface of the padding which engages the corresponding finger region, and the padding is additionally held by the stitch which connects the upper and inner finger regions with each other.

It is particularly preferable and advantageous when the finger region to which the hat-shaped padding is secured is an inner finger region. The fingertips of a hand of a goalkeeper particularly forcefully engage the finger regions of the inner portion of the glove. When the hat-shaped padding is secured to the inner finger region, the padding is additionally supported against this finger region by the forces applied by the fingertips.

When a thumb region of a goalkeeper's glove also has a fingertip cap, it is advantageous to also provide the thumb region finger cap with the inventive hat-shaped padding. Providing the thumb region fingertip cap with the inventive padding further improves the use characteristics of the goalkeeper's glove.

BRIEF DESCRIPTION OF THE DRAWINGS

The objects and advantages of the present invention will become more apparent and the invention itself will be best understood from the following detailed description of the Preferred Embodiment, when read with reference to the accompanying drawings, wherein.

DETAILED DESCRIPTION OF THE PREFERRED EMBODIMENT

Figure 1:
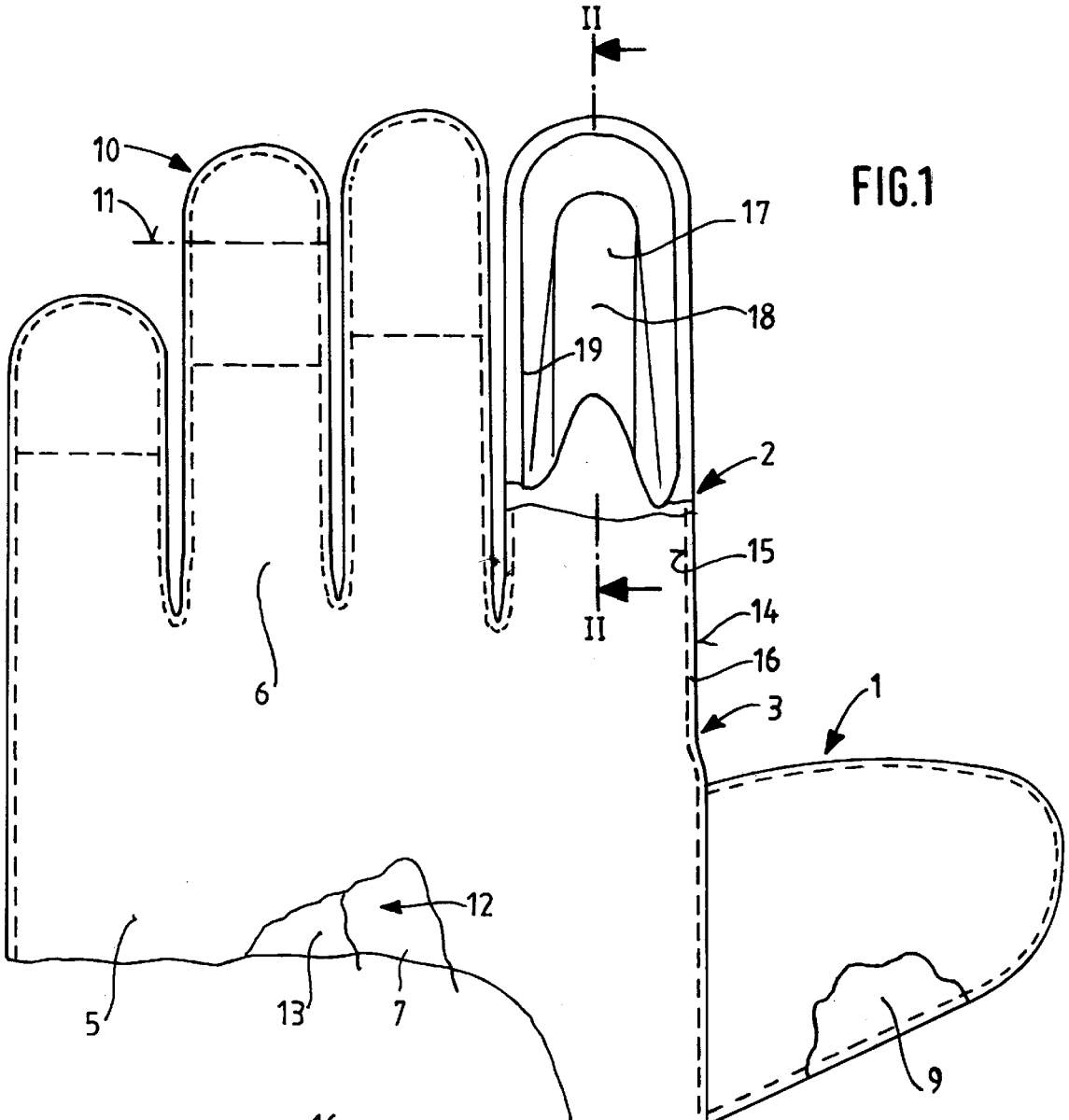
FIG. 1 shows a plan view with a cut-out of a goalkeeper's glove with fingertip paddings according to the present invention.

A goalkeeper's glove according to the present invention which is shown in the drawings, has a thumb region 1, four front finger regions 2, a hand region 3, and a wrist region 4. An upper wrist region, an upper hand region and four upper finger regions 6 form together a one-piece upper portion 5 of the glove. The inner hand region, four front inner finger regions 8, and an inner finger region 9 of the thumb region 1 form together a one-piece inner portion 7 of the glove. The upper portion 5 is superimposed on the inner portion 7. The tips of the front finger regions 2 and of the thumb region 1 define fingertip caps 10 the ends of which adjacent to the hand region 3 are marked with a dash line 11 (only one line 11 being shown). The inner portion 7 is formed of a carrier layer 12 with a superimposed outer latex layer 13. The four front finger regions 2 and the thumb region 1 are stitched along their respective lateral edges 14 with seams 15 so that ridge-like butts 16 are formed.

Figure 2:
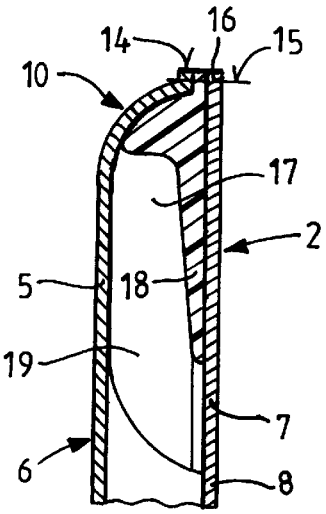
FIG. 2 shows a cross-sectional view along line II—II in FIG. 1.

In each fingertip cap of each finger region 2, there is provided a hat-shaped padding 17. The hat-shaped padding 17 is formed as a circumferential, partially open finger seat, i.e., a finger seat which, when viewed from the opening through which a finger is pushed in, is not circumferentially closed. The hat-shaped padding 17 is formed as a shaped piece which is additionally provided with a lower projection 18 and two side projections or extensions 19. As shown in FIG. 2, the external dimension of the hat-shaped padding 17 between the upper and inner portions of the glove narrows in the direction toward the free end of the finger region. That is, the padding 17 is adapted to the narrowing of the inner space of a finger region toward the free end of the finger region.

Though the present invention has been shown and described with reference to a preferred embodiment, such is merely illustrative of the present invention and is not to be construed as a limitation thereof, and the present invention includes all modifications, variations and/or alternate embodiments within the spirit and scope of the present invention as defined by the appended claims.

What is claimed is:

1. A goalkeeper's glove, comprising:

an upper portion having four upper finger regions and an upper hand region; and an inner portion having four inner finger regions and an inner hand region, wherein each upper finger region is connected with a respective inner finger region along lateral edges thereof, and each upper finger region and each inner finger region form, respectively, together a common free end having a fingertip cap, wherein at least one fingertip cap is provided with a hat-shaped elastically compressible padding formed of a porous rubber material and fixedly secured at one side thereof to one of upper and inner finger regions forming the at least one fingertip cap, and wherein the hat-shaped padding is formed as a finger seat open at a side thereof opposite to the one side.

2. A goalkeeper's glove as set forth in claim 1, wherein an inner surface of the one of upper and inner finger regions comprises a pierced textile layer engageble by the hat-shaped padding.

3. A goalkeeper's glove as set forth in claim 1, wherein the porous rubber-like material comprises a polyurethane foamed material.

4. A goalkeeper's glove as set forth in claim 1, wherein the hat-shaped padding is fixedly secured to the one of upper and inner finger regions as an injection-molded part.

5. A goalkeeper's glove as set forth in claim 1, wherein an end wall of the hat-shaped padding has a thickness greater than a side wall thereof.

6. A goalkeeper's glove as set forth in claim 1, wherein a height of the hat-shaped padding gradually decreases toward a lateral edge of respective finger regions.

7. A goalkeeper's glove as set forth in claim 1, wherein another of upper and inner finger regions forming the at least one fingertip cap loosely engages the hat-shaped padding.

8. A goalkeeper's glove as set forth in claim 4, wherein the hat-shaped padding forms a seam ledge along a lateral edge of the upper and inner finger regions forming the at least one fingertip cap.

9. A goalkeeper's glove as set forth in claim 1, wherein the one of upper and inner finger regions is the inner finger region.

* * * * *